US009924279B2

(12) United States Patent
Jensen et al.

(10) Patent No.: US 9,924,279 B2
(45) Date of Patent: Mar. 20, 2018

(54) HEARING SYSTEM COMPRISING A BINAURAL SPEECH INTELLIGIBILITY PREDICTOR

(71) Applicant: Oticon A/S, Smørum (DK)

(72) Inventors: Jesper Jensen, Smørum (DK); Asger Heidemann Andersen, Smørum (DK); Jan Mark De Haan, Smørum (DK)

(73) Assignee: Oticon A/S, Smørum (DK)

( * ) Notice: Subject to any disclaimer, the term of this patent is extended or adjusted under 35 U.S.C. 154(b) by 81 days.

(21) Appl. No.: 15/040,042

(22) Filed: Feb. 10, 2016

(65) Prior Publication Data

US 2016/0234610 A1 Aug. 11, 2016

(30) Foreign Application Priority Data

Feb. 11, 2015 (EP) ..... 15154666

(51) Int. Cl.
*H04R 25/00* (2006.01)
*H04R 3/00* (2006.01)

(52) U.S. Cl.
CPC ..... *H04R 25/552* (2013.01); *H04R 3/005* (2013.01); *H04R 25/505* (2013.01); *H04R 2225/43* (2013.01); *H04R 2225/55* (2013.01)

(58) Field of Classification Search
CPC .... H04R 3/005; H04R 25/505; H04R 25/552; H04R 2225/43
See application file for complete search history.

(56) References Cited

U.S. PATENT DOCUMENTS

2004/0175012 A1* 9/2004 Roeck ..... H04R 25/505 381/317
2009/0304203 A1* 12/2009 Haykin ..... H04R 25/407 381/94.1
2011/0051963 A1* 3/2011 Barthel ..... H04R 25/70 381/314

FOREIGN PATENT DOCUMENTS

| | | | |
|---|---|---|---|
| EP | 2 088 802 | A1 | 8/2009 |
| EP | 2 372 700 | A1 | 10/2011 |
| WO | WO 2007/028250 | A2 | 3/2007 |

OTHER PUBLICATIONS

Kjems et al., "Maximum likelihood based noise covariance matrix estimation for multi-microphone speech enhancement", 20th European Signal Processing Conference (EUSIPCO 2012), Aug. 27-31, 2012, XP032254727, ISBN: 978-1-4673-1068-0, pp. 295-299.

(Continued)

*Primary Examiner* — Brian Ensey
(74) *Attorney, Agent, or Firm* — Birch, Stewart, Kolasch & Birch, LLP

(57) ABSTRACT

The application relates to a binaural hearing system comprising left and right hearing devices, e.g. hearing aids, each comprising a) a multitude of input units, each providing a time-variant electric input signal $x_i(t)$ representing sound received at an $i^{th}$ input unit, t representing time, the electric input signal $x_i(t)$ comprising a target signal component $s_i(t)$ and a noise signal component $v_i(t)$, the target signal component originating from a target signal source; b) a configurable signal processing unit for processing the electric input signals and providing a processed signal y(t); c) an output unit for creating output stimuli to the user, d) transceiver circuitry allowing information to be exchanged between the hearing devices, and e) a binaural speech intelligibility (SI) prediction unit for providing a binaural SI-measure of the predicted speech intelligibility of the user when exposed to said output stimuli, based on processed signals $y_l(t)$, $y_r(t)$ from the signal processing units of the respective left and right hearing devices. This allows the hearing devices to control the processing of the respective electric input signals based on said binaural SI-measure.

18 Claims, 4 Drawing Sheets

(56) References Cited

OTHER PUBLICATIONS

Srinivasan et al., "Binary and ratio time-frequency masks for robust speech recognition", Speech Communication, Elsevier Science Publishers, Amsterdam, NL, Nov. 1, 2006, XP027926305, ISSN: 0167-6393, vol. 48, No. 11, pp. 1486-1501.

Beutelmann et al., "Prediction of Speech Intelligibility in Spatial Noise and Reverberation for Normal-hearing and Hearing-impaired Listeners," J. Acoust. Soc. Am., vol. 120, No. 1, Jul. 2006, pp. 331-342.

Beutelmann et al., "Revision, Extension, and Evaluation of a Binaural Speech Intelligibility Model," J. Acoust. Soc. Am., vol. 127, No. 4, Apr. 2010, pp. 2479-2497.

Jensen et al., "Analysis of Beamformer Directed Single-channel Noise Reduction System for Hearing Aid Applications," ICASSP, 2015, pp. 5728-5732.

* cited by examiner

HEARING SYSTEM COMPRISING A BINAURAL SPEECH INTELLIGIBILITY PREDICTOR

TECHNICAL FIELD

The present application relates to hearing system comprising hearing devices in a binaural mode of operation, in particular to speech intelligibility. The disclosure relates specifically to a binaural hearing system comprising left and right hearing devices each comprising transceiver circuitry allowing a communication link to be established and information to be exchanged between the left and right hearing devices.

The application furthermore relates to a method of providing a binaural speech intelligibility predictor.

The application further relates to a data processing system comprising a processor and program code means for causing the processor to perform at least some of the steps of the method.

Embodiments of the disclosure may e.g. be useful in applications such as binaural hearing systems.

BACKGROUND

The basic goal of any hearing aid (HA) system is to improve speech intelligibility (SI) in conversational situations. Current HAs succeed, to a large extent, in achieving this goal, when conversation takes place in acoustically quiet surroundings. However, in complex acoustic situations, e.g. with disturbing noise sources and/or reverberation, existing HAs are still unable to improve SI sufficiently.

Rather than trying to optimize SI directly, existing HAs tend to process the microphone signals to maximize other quantities which are assumed or known to correlate with intelligibility. For example, HA noise reduction systems tend to maximize a signal-to-noise-ratio (SNR) because a) this is practically possible, and b) it is known that increasing SNR tends to increase SI. The drawback of this approach is that it is indirect/implicit: increasing SNR tends to increase SI, but there is not always a clear one-to-one map.

SUMMARY

Instead, it is proposed to apply a more direct/explicit approach where SI is estimated by a speech intelligibility model online in the HA system (e.g. two wirelessly connected hearing aids, or two hearing aids wirelessly connected to one or more external devices), and where the signal processing employed in the HA system may be adapted to maximize this SI estimate.

The proposed idea requires that the two acoustic signals reaching the eardrums of the HA user (i.e., the outputs of the left and right HA) can be processed together to produce an estimate of the SI experienced by a particular HA user at a given moment in time. With recent advances in wireless technologies, this requirement can be fulfilled, since one of these signals, e.g. the output signal of the right HA may be transmitted wirelessly to the left HA, where an SI estimate may be produced.

An object of the present application is to provide improved intelligibility of speech in a binaural hearing system.

Objects of the application are achieved by the invention described in the accompanying claims and as described in the following.

A Binaural Hearing System:

In an aspect of the present application, an object of the application is achieved by a binaural hearing system comprising left and right hearing devices adapted for being located at or in left and right ears of a user, or adapted for being fully or partially implanted in the head of the user, each of the left and right hearing devices comprising a) A multitude of input units $IU_i$, i=1, M, M being larger than or equal to two, each being configured to provide a time-variant electric input signal $x_i(t)$ representing sound received at an $i^{th}$ input unit, t representing time, the electric input signal $x_i(t)$ comprising a target signal component $s_i(t)$ and a noise signal component $v_i(t)$, the target signal component originating from a target signal source;

b) A configurable signal processing unit for processing the electric input signals and providing a processed signal y(t);

c) An output unit for creating output stimuli configured to be perceivable by the user as sound based on the processed signal from the signal processing unit, d) Transceiver circuitry for allowing a communication link to be established and information to be exchanged between said left and right hearing devices. Wherein the binaural hearing system further comprises e) A binaural speech intelligibility prediction unit for providing a binaural SI-measure of the predicted speech intelligibility of the user when exposed to said output stimuli, based on the processed signals yl(t), yr(t) from the signal processing units of the respective left and right hearing devices, wherein the configurable signal processing units of the left and right hearing devices are adapted to control the processing of the respective electric input signals based on said binaural SI-measure.

This has the advantage of providing an alternative scheme for improving speech intelligibility in a binaural hearing system.

In an embodiment, the communication link is established on a wired connection between the left and right hearing devices. In an embodiment, each of the left and right hearing devices comprises antenna and transceiver circuitry allowing said communications link to be wireless.

In an embodiment, the binaural hearing system is configured to provide the processed signals $y_l(t)$, $y_r(t)$ and/or one or more of the electric input signals $x_{i,l}(t)$, $x_{i,r}(t)$, i=1, 2, . . . , M, of the left and right hearing devices, respectively, in a time-frequency representation, $Y_l(k,m)$, $Y_r(k,m)$, $X_{i,l}(k,m)$, $X_{i,r}(k,m)$, respectively, in a number of frequency bands and a number of time instances, k being a frequency band index, m being a time index.

In an embodiment, the intelligibility prediction unit is located in a first one of the left and right hearing devices.

In an embodiment, the binaural hearing system comprises an auxiliary device wherein said intelligibility prediction unit is located, said left and right hearing devices and said auxiliary device each comprising respective antenna and transceiver circuitry for allowing a communication link to be established and information to be exchanged between said auxiliary device and said left and right hearing devices.

In an embodiment, the binaural speech intelligibility prediction unit comprises a hearing loss model unit for modelling a hearing loss of the user to provide HL-modified signals $y'_l(t)$ and $y'_r(t)$, based on the processed signals $y_l(t)$ and $y_r(t)$, respectively.

By subjecting the binaural speech signal (e.g. signals $y_l$, $y_r$ in FIG. 2, 3, 4), which have been subject to signal processing (e.g. to compensate for a hearing loss of the user) to a hearing loss model, the binaural speech intelligibility prediction unit can e.g. provide a measure of the intelligibility of the speech signal for an aided hearing impaired person. Such scheme may hence be used to online optimization of signal processing in a hearing device (e.g. a hearing aid).

In an embodiment, the hearing loss model unit is configured to add uncorrelated noise, which is spectrally shaped according to the user's frequency dependent hearing loss, to the the processed signals $y_l(t)$, $y_r(t)$ of the respective left and right hearing devices to provide HL-modified signals $y'_l(t)$ and $y'_r(t)$. The term 'uncorrelated noise' is in the present context taken to mean noise that is (essentially) uncorrelated with the target signal. The frequency dependent hearing loss for a given ear may e.g. be based on an audiogram of the user for that ear.

In an embodiment, the binaural speech intelligibility prediction unit comprises a covariance estimation unit configured to provide an estimate of the inter-aural target and noise covariance matrices $C_s(k,m)$ and $C_v(k,m)$, respectively, for each frequency band of the signals involved. In an embodiment, the inter-aural target and noise covariance matrices $C_s(k,m)$ and $C_v(k,m)$ are determined by a maximum likelihood method, for example based on the assumption that the direction to the target signal source (e.g. as defined by the look vector d(k,m)) is known.

In an embodiment, the binaural speech intelligibility prediction unit comprises a beamformer unit (cf. e.g. unit BFWGT in FIG. 4) for providing respective estimates of SNR-optimal beamformers comprising—generally complex-valued—beamformer weights $w_l(k,m)$ and $w_r(k,m)$, respectively, for each frequency band and time instant.

In an embodiment, the binaural speech intelligibility prediction unit comprises a perturbation unit for applying jitter to said SNR-optimal beamformer weights $w_l(k,m)$ and $w_r(k,m)$, to provide respective jittered beamformer weights $\tilde{w}_l(k,m)$ and $\tilde{w}_r(k,m)$. In an embodiment, the jittered beamformer weights are e.g. generated by introducing random gain errors and delay errors to the SNR-optimal beamformer weights.

In an embodiment, the binaural speech intelligibility prediction unit comprises a beamformer filter (cf. e.g. block (Apply) BF in FIG. 4) wherein the processed signals $y_l(t)$ and $y_r(t)$ of the left and right hearing devices, respectively, are filtered using the respective SNR-optimal beamformer weights $w_l(k,m)$ and $w_r(k,m)$ or the respective jittered beamformer weights $\tilde{w}_l(k,m)$ and $\tilde{w}_r(k,m)$ (cf. e.g. FIG. 4) to provide, an estimated signal-to-noise ratio snr(k,m) computed as a function of time and frequency.

In an embodiment, the binaural speech intelligibility prediction unit comprises a speech intelligibility prediction unit for providing a resulting SI-measure based on the estimated time-frequency dependent signal-to-noise ratio snr(k,m).

In an embodiment, the resulting SI-measure is further based on said estimates of the inter-aural target and noise covariance matrices $C_s(k,m)$ and $C_v(k,m)$, respectively.

In an embodiment, the binaural speech intelligibility prediction unit comprises a processing control unit for providing respective processing control signals to control the processing of the respective electric input signals in the configurable signal processing units of the left and right hearing devices, respectively, based on said binaural or said resulting SI-measure.

In an embodiment, the binaural speech intelligibility prediction unit is configured to provide said binaural or said SI-measure based on said processed signals $y_l(t)$ and $y_r(t)$ of the left and right hearing devices, respectively, and one or more of the electric input signals $x_{i,l}(t)$, $x_{i,r}(t)$, i=1, 2, . . . , M, of the left and right hearing devices, respectively and/or on information regarding the processing currently applied to the electric input signals of the signal processing units of the left and right hearing devices, respectively.

In an embodiment, the information regarding the processing currently applied to the electric input signals of the signal processing units of the left and right hearing devices, respectively, comprises one or more of information regarding a) filter weights of a beamformer as a function of frequency, b) gain/suppression applied by a single-channel noise reduction filter as a function of frequency, c) gain applied by an amplification/dynamic range compression system as a function of frequency.

In an embodiment, the hearing system comprises an auxiliary device.

In an embodiment, the system is adapted to establish a communication link between the hearing device(s) and the auxiliary device to provide that information (e.g. control and status signals, possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device. In an embodiment, the auxiliary device is or comprises a remote control for controlling functionality and operation of the hearing device(s). In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth or some other standardized or proprietary scheme).

In an embodiment, the hearing device is adapted to provide a frequency dependent gain and/or a level dependent compression and/or a transposition (with or without frequency compression) of one or frequency ranges to one or more other frequency ranges, e.g. to compensate for a hearing impairment of a user. In an embodiment, the hearing device comprises a signal processing unit for enhancing the input signals and providing a processed output signal.

The hearing device comprises an output unit for providing stimuli perceived by the user as an acoustic signal based on the processed electric signal. In an embodiment, the output unit comprises a number of electrodes of a cochlear implant. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

In an embodiment, the hearing device comprises an antenna and transceiver circuitry for wirelessly receiving a direct electric input signal from another device, e.g. a communication device or another hearing device. In an embodiment, the hearing device comprises a (possibly standardized) electric interface (e.g. in the form of a connector) for receiving a wired direct electric input signal from another device, e.g. a communication device or another hearing device. In an embodiment, the direct electric input signal represents or comprises an audio signal and/or a control signal and/or an information signal. In an embodiment, the hearing device comprises demodulation circuitry for demodulating the received direct electric input to provide the direct electric input signal representing an audio signal and/or a control signal e.g. for setting an operational parameter (e.g. volume) and/or a processing parameter of the hearing device. In general, the wireless link established by a transmitter and antenna and transceiver circuitry of the hearing device can be of any type. In an embodiment, the wireless link is used under power constraints, e.g. in that the hearing device is or comprises a portable (typically battery driven) device. In an embodiment, the wireless link is a link based on near-field communication, e.g. an inductive link based on an inductive coupling between antenna coils of transmitter and receiver parts. In another embodiment, the wireless link is based on far-field, electromagnetic radiation. In an embodiment, the communication via the wireless link is arranged according to a specific modulation scheme, e.g. an analogue modulation scheme, such as FM (frequency modulation) or AM (amplitude modulation) or PM (phase modulation), or a digital modulation scheme, such as ASK (amplitude shift keying), e.g. On-Off keying, FSK (frequency shift keying), PSK (phase shift keying) or QAM (quadrature amplitude modulation).

In an embodiment, the communication between the hearing device and the other device is in the base band (audio frequency range, e.g. between 0 and 20 kHz). Preferably, communication between the hearing device and the other device is based on some sort of modulation at frequencies above 100 kHz. Preferably, frequencies used to establish a communication link between the hearing device and the other device is below 50 GHz, e.g. located in a range from 50 MHz to 50 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology).

In an embodiment, the hearing device has a maximum outer dimension of the order of 0.08 m (e.g. a head set). In an embodiment, the hearing device has a maximum outer dimension of the order of 0.04 m (e.g. a hearing instrument).

In an embodiment, the hearing device is portable device, e.g. a device comprising a local energy source, e.g. a battery, e.g. a rechargeable battery.

In an embodiment, the hearing device comprises a forward or signal path between an input transducer (microphone system and/or direct electric input (e.g. a wireless receiver)) and an output transducer. In an embodiment, the signal processing unit is located in the forward path. In an embodiment, the signal processing unit is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, the hearing devices comprise an analogue-to-digital (AD) converter to digitize an analogue input with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, a signal of the forward and/or analysis path of the hearing device is split into a number NI of frequency bands, where NI is e.g. larger than 5, such as larger than 10, such as larger than 50, such as larger than 100, such as larger than 500, at least some of which are processed individually. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing device comprises a level detector (LD) for determining the level of an input signal (e.g. on a band level and/or of the full (wide band) signal). The input level of the electric microphone signal picked up from the user's acoustic environment is e.g. a classifier of the environment. In an embodiment, the level detector is adapted to classify a current acoustic environment of the user according to a number of different (e.g. average) signal levels, e.g. as a HIGH-LEVEL or LOW-LEVEL environment.

In a particular embodiment, the hearing device comprises a voice activity detector (VAD) for determining whether or not an input signal comprises a voice signal (at a given point in time). A voice signal is in the present context taken to include a speech signal from a human being. It may also include other forms of utterances generated by the human speech system (e.g. singing). In an embodiment, the voice activity detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. artificially generated noise). In an embodiment, the voice activity detector is adapted to detect as a VOICE also the user's own voice. Alternatively, the voice detector is adapted to exclude a user's own voice from the detection of a VOICE.

In an embodiment, the hearing device comprises an own voice detector for detecting whether a given input sound (e.g. a voice) originates from the voice of the user of the system. In an embodiment, the microphone system of the hearing device is adapted to be able to differentiate between a user's own voice and another person's voice and possibly from NON-voice sounds.

In an embodiment, the hearing device further comprises other relevant functionality for the application in question, e.g. compression, feedback reduction, etc.

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof.

Use:

In an aspect, use of a hearing device as described above, in the 'detailed description of embodiments' and in the claims, is moreover provided. In an embodiment, use is provided in a system comprising one or more hearing instruments, headsets, ear phones, active ear protection systems, etc., e.g. in handsfree telephone systems, teleconferencing systems, public address systems, karaoke systems, classroom amplification systems, etc.

A Method:

In an aspect, a method of providing a binaural speech intelligibility predictor in a binaural hearing system comprising comprising left and right hearing devices adapted for being located at or in left and right ears of a user, or adapted for being fully or partially implanted in the head of the user is furthermore provided by the present application. The method comprises modelling a potential hearing loss by adding uncorrelated noise, spectrally shaped according to the haring loss of the user;

- estimating the inter-aural target and noise covariance matrices for each frequency sub-band of the output signals of the left and right hearing devices;
- estimating SNR-optimal beamformers in the form of, generally complex-valued, beamformer weights for each frequency band for the left and right hearing devices, respectively;
- generating jittered beamformer weights by applying jitter to the beamformer weights for each frequency band for the left and right hearing devices, respectively;
- applying jittered beamformer weights to the output signals of the left and right hearing devices thereby providing an apparent signal-to-noise ratio as a function of time and frequency; and
- producing a final estimate of the speech intelligibility experienced by the user.

It is intended that some or all of the structural features of the system described above, in the 'detailed description of embodiments' or in the claims can be combined with embodiments of the method, when appropriately substituted by a corresponding process and vice versa. Embodiments of the method have the same advantages as the corresponding systems.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

Definitions:

In the present context, a 'hearing device' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing device may comprise a single unit or several units communicating electronically with each other.

More generally, a hearing device comprises an input transducer for receiving an acoustic signal from a user's surroundings and providing a corresponding input audio signal and/or a receiver for electronically (i.e. wired or wirelessly) receiving an input audio signal, a signal processing circuit for processing the input audio signal and an output means for providing an audible signal to the user in dependence on the processed audio signal. In some hearing devices, an amplifier may constitute the signal processing circuit. In some hearing devices, the output means may comprise an output transducer, such as e.g. a loudspeaker for providing an air-borne acoustic signal or a vibrator for providing a structure-borne or liquid-borne acoustic signal. In some hearing devices, the output means may comprise one or more output electrodes for providing electric signals.

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory cortex and/or to other parts of the cerebral cortex.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. SmartPhones), public-address systems, car audio systems or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

Figure 1:
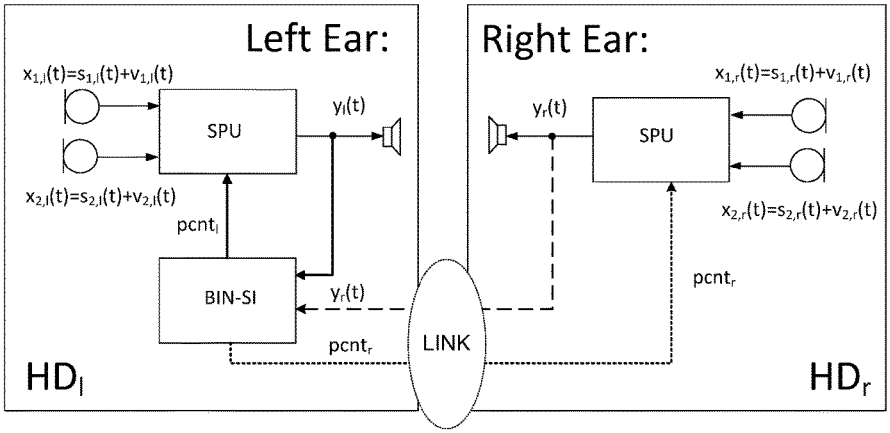
FIG. 1 shows a first embodiment of a binaural hearing system according to the present disclosure.

FIG. 1 shows a first embodiment of a binaural hearing system according to the present disclosure. The signal processing of each of the left and right hearing devices is guided by an estimate of the speech intelligibility experienced by the hearing aid user (cf. control signals $pcnt_l$, $pcnt_r$ from the binaural speech intelligibility predictor (BIN-SI) to the respective signal processing units (SPU) of the left and right hearing devices). In this example, the SI estimation/prediction takes place in the left-ear hearing device (Left Ear:) using the output signals of both HAs (the output signal of the right-ear hearing device (Right Ear:) is wirelessly transmitted to the left-ear hearing device (Left Ear:)). Dashed lines indicate wired or wireless signal transmission via a communication link (LINK).

The general idea of the present disclosure is illustrated in FIG. 1. In this figure, each hearing device is schematically depicted comprising of two microphones, a signal processing block (SPU and potentially a binaural SI prediction module BIN-SI), and a loudspeaker. The microphones pick up a—potentially noisy (time varying) signal x(t)—which generally consists of a target signal component s(t) and an undesired signal component v(t) (in the figure, the subscripts 1, 2 indicate a first and second (e.g. front and rear) microphone, respectively, while the subscripts l, r indicate whether it is the left or right ear hearing device ($HD_l$, $HD_r$, respectively)). The hearing devices are wirelessly connected. In the depicted situation, it is assumed that the binaural SI-processing (cf. unit BIN-SI) takes place in the left hearing device. This requires access to the output signal $y_l(t)$ of the loudspeaker of the left-ear hearing device ($HD_l$), which is easily available, and to the output signal $y_r(t)$ of the loudspeaker of the right-ear hearing device ($HD_r$), which we assume is (e.g. wirelessly) transmitted (dashed line) via communications link (LINK) between the two hearing devices. Based on the predicted SI, the signal processing of each hearing device may be (individually) adapted (cf. signals $pcnt_l$, $pcnt_r$). Since the SI predicted is performed in the left-ear hearing device ($HD_r$), adaptation of the processing in the right-ear hearing device ($HD_r$) requires a wireless control processing signal ($pcnt_r$) to be transmitted from left to right-ear hearing device to the right ear hearing device (dashed line).

In FIG. 1, each of the left and right hearing devices comprise two microphones. In other embodiments, each (or one) of the hearing devices may comprises three or more microphones. Likewise, in FIG. 1, the binaural speech intelligibility predictor (BIN-SI) is located in the left hearing device ($HD_l$). Alternatively, the binaural speech intelligibility predictor (BIN-SI) may be located in the right hearing device ($HD_r$), or alternatively in both, preferably performing the same function in each hearing device. The latter embodiment consumes more power and requires a two-way exchange of output audio signals ($y_l$, $y_r$), whereas the exchange of processing control signals ($pcnt_r$ in FIG. 1) can be omitted. In still another embodiment, the binaural speech intelligibility predictor (BIN-SI) is located in a separate auxiliary device, e.g. a remote control (e.g. embodied in a SmartPhone) requiring that an audio link can be established between the hearing devices and the auxiliary device for receiving output signals ($y_l$, $y_r$) from, and transmitting processing control signals ($pcnt_l$, $pcnt_r$) to, the respective hearing devices ($HD_l$, $HD_l$).

The processing performed in the signal processing units (SPU) and controlled or influenced by the control signals ($pcnt_l$, $pcnt_r$) of the respective left and right hearing devices ($HD_l$, $HD_l$) from the binaural speech intelligibility predictor (BIN-SI) may in principle include any processing algorithm influencing speech intelligibility, e.g. spatial filtering (beamforming) and noise reduction, compression, feedback cancellation, etc. (cf. e.g. FIG. 6). The adaptation of the signal processing of a hearing device based on the estimated binaural SI include (but are not limited to):

1. Adapting the aggressiveness of beamformers of the hearing system. Specifically, for binaural beamformers, it is well-known that the beamformer configuration involves a trade-off between noise reduction and spatial correctness of the noise cues. In one extreme setting, the noise is maximally reduced, but all noise signals sound as if originating from the direction of the target signal source. The trade-off that leads to maximum SI is generally time-varying and generally unknown. With the proposed approach, however, it is possible to adapt the beamformer stage of a given hearing device to produce maximum SI at all times.
2. Adapting the aggressiveness of a (single-channel (SC)) noise reduction system. Often a beamformer stage is followed by an SC noise reduction stage (cf. e.g. FIG. 6). The aggressiveness of the SC noise reduction filter is adaptable (e.g. by changing the maximum attenuation allowed by the SC noise reduction filter). The proposed approach allows to choose the SI optimal tradeoff, i.e., a system that suppresses an appropriate amount of noise without introducing SI-disturbing artefacts in the target speech signal.
3. For systems with adaptable analysis/synthesis filterbanks, the analysis/synthesis filter bank leading to maximum SI may be chosen. This implies to change the time-frequency tiling, i.e., the bandwidths and/or sampling rate used in individual subbands to deliver maximum SI in accordance with the target signal and acoustic situation (e.g., noise type, level, spatial distribution, etc.).
4. If the binaural SI prediction unit estimates the maximum SI of the binaural hearing system to be so low that it is of no use for the user, then an indication may be given to the user (e.g. via a sound signal), that the HA system is unable to operate in the given acoustical conditions. It may then adapt its processing, e.g. to at least not introduce sound quality degradations, or to go to a "power-saving" mode, where the signal processing is limited to save power.

Binaural Speech Intelligibility Prediction

The proposed method relies on the ability to—given a binaural signal ($y_l(t)$ and $y_r(t)$) in the embodiment in FIG. 1—predict the SI experienced by the user of the hearing system. To this end, a binaural SI prediction algorithm is needed. While such algorithms are known from literature, e.g. [1-6], these methods cannot be used in the situation at hand, since they generally require access to the target signal component and the undesired signal component, impinging on the left and right ear drum, each in isolation. In the current situation, these signal components are unavailable in separation: only the noisy signals (i.e., the combined target and undesired signal components) picked up by the microphones of the hearing devices along with the processed output signals are available.

Existing Methods—and why they Cannot be Used.

However, as described in the following, a scheme is proposed, which can provide a binaural SI estimate, even though the target speech signal and the disturbing noise component are unavailable in separation. Specifically, the method proposed in [1, 2]—which cannot be used in the current situation—use the target signal and the noise signal components (available in isolation) to establish an SNR-optimal binaural beamformer. In other words, they find the coefficients of the linear combination of microphone signals (individual frequency subbands), which lead to maximum SNR in the beamformer output. In [1, 2] it is realized, however, that the optimal beamformer weights lead to SI predictions, which are superior to human SI performance. To account for this fact, jitter (i.e. noise) is added to the optimal beamformer weights, to reduce the beamformer performance to be in accordance with human performance. Finally, in [1, 2] the target and noise signal components are passed through this jittered beamformer; then the resulting beamformed target and noise signal components are passed through a monaural SI predictor (ESII, [7, 8]), to produce an SI estimate.

Proposed Approach

In the situation at hand [1,2] cannot be used because target and noise signals cannot be observed in separation. To propose an approach that can be used in this situation, let us assume that noise v(n) is additive and uncorrelated with the target signal s(n). This assumption is traditionally made in the area of speech enhancement because it is a reasonable assumption in many practical situations: it is obviously valid in situations where the noise generation process is unrelated to the target speech generation process, e.g. a conversation in a car cabin environment while driving; furthermore, it is an operational assumption even in situations where the undesired signal component is not obviously uncorrelated from a target speech signal, e.g., in reverberant environments, cf. e.g. [12]. Furthermore, let us assume that the signal processing of the hearing devices to be linear across sufficiently short time durations. The assumption is approximately valid for many of the standard signal processing algorithms of a hearing device, e.g., beamforming, which are generally time-varying, linear operations. Other algorithms, e.g., amplification and dynamic range compression [13], are inherently non-linear operations: however, since these algorithms tend to change relatively slowly across time, they may be assumed roughly linear (constant), across time-durations of several 10 s of ms, and often across several 100 s of ms. With these assumptions in mind, we propose to estimate the SI based on the users 'eardrum signals' ($y_l(t)$ and $y_r(t)$) in the example in FIG. 1), as outlined in FIG. 2.

Figure 2:
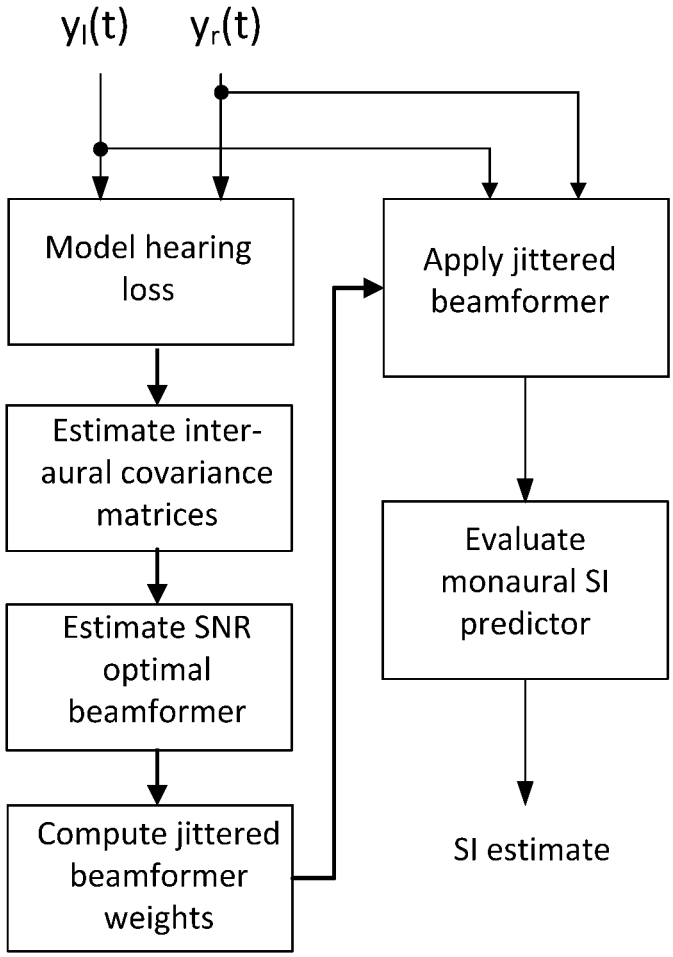
FIG. 2 shows a flow diagram for a method of providing a binaural speech intelligibility predictor based on the output signals $y_l(t)$ and $y_r(t)$ of left and right hearing devices, respectively of a binaural hearing system.

FIG. 2 shows a flow diagram for a method of providing a binaural speech intelligibility predictor based on the output signals yl(t) and yr(t) of left and right hearing devices, respectively of a binaural hearing system. It is assumed that these operations are performed in the frequency domain. Specifically, we assume that the operations are applied (in parallel) to frequency sub-bands with bandwidths which may resemble the critical band filters of the human auditory system.

First, a potential hearing loss is modelled (block Model hearing loss in FIG. 2). This can be done by simply adding uncorrelated noise, spectrally shaped according to the audiogram of the user, as proposed in [1,2]. While it is difficult to estimate reliably the target and noise components based on signals $y_l(t)$ and $y_r(t)$ or signals $x_{1,l}(t)$ and $x_{1,r}(t)$), it is possible to estimate the inter-aural target and noise covariance matrices (for each frequency sub-band of the signals involved), cf. block Estimate interaural covariance matrices in FIG. 2, and also FIG. 3.

Figure 3:
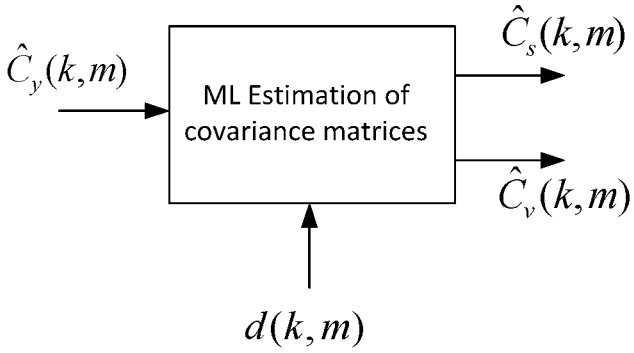
FIG. 3 shows an example of estimation of covariance matrices of target and an undesired (noise) component (none of which can be observed directly), based on covariance matrix of signal y(k,m) which can be observed.

FIG. 3 shows an example of estimation of covariance matrices of target and an undesired (noise) component (none of which can be observed directly), based on covariance matrix of signal y(k,m) which can be observed.

These covariance matrices are accurately defined in the following. Let us, to be closer to a practical implementation, make the description in the time-frequency plane. So, let $y_l(k,m)$ denote the output signal $y_l(n)$ of the left-ear hearing aid at frequency index k and time index m. Similarly, let $y_r(k,m)$ denote the output signal $y_r(n)$ of the right-ear hearing aid at frequency index k and time index m. Using the assumption that the signal processing of the hearing devices is linear, and that the noise is additive, the output signals of the left-ear and right-ear hearing aids, $y_l(k,m)$ and $y_r(k,m)$, respectively, can be written as $$y_l(k,m)=s_l(k,m)+v_l(k,m)$$

and $$y_r(k,m)=s_r(k,m)+v_r(k,m),$$

where $$s_l(k,m)=f(s_{l,1}(k,m)+s_{l,2}(k,m)),$$

$$s_r(k,m)=f(s_{r,1}(k,m)+s_{r,2}(k,m)),$$

$$v_l(k,m)=f(v_{l,1}(k,m)+v_{l,2}(k,m)),$$

$$v_r(k,m)=f(v_{r,1}(k,m)+v_{r,2}(k,m)),$$

and where the function $f(\bullet)$ represents the hearing aid signal processing (which is assumed to be linear in the equations above). Furthermore, let $$y(k,m)=[y_l(k,m)y_r(k,m)]^T$$

denote the (2×1 in this case) vector with the output signal of the left- and right-ear hearing devices (for a particular time frequency index), and similarly define vectors $$s(k,m)=[s_l(k,m)s_r(k,m)]^T$$

and $$v(k,m)=[v_l(k,m)v_r(k,m)]^T,$$

where superscript T indicates vector transposition.

The cross-covariance matrix $C_y(k,m)$ of the output signals (that is, the inter-aural covariance matrix) is then defined as $$C_y(k,m)=E[y(k,m)y(k,m)^H],$$

where E[•] denotes the statistical expectation operator, and the superscript H denotes Hermitian (complex-conjugate) transposition. Similar definitions hold for the inter-aural target signal covariance matrix $C_s(k,m)$ and the undesired signal covariance matrix $C_v(k,m)$.

From the assumption of uncorrelated noise, it follows that $$C_y(k,m)=C_s(k,m)+C_v(k,m).$$

Estimation of these target and noise covariance matrices $C_s(k,m)$ and $C_v(k,m)$ is possible using (the assumption) that target and noise processed are uncorrelated, and possibly using prior knowledge that the target source is located frontally to the hearing aid user. As an example (which may be applied in the present situation with a few modifications) FIG. 3 outlines the maximum likelihood approach described in [9,10], for estimating the matrices $C_s(k,m)$ and $C_v(k,m)$ based on the assumption that the direction to the target signal source is known, and knowledge about the structure of $C_v(k,m)$ (these assumptions are practically relevant in a typical hearing aid situation). In FIG. 2, the vector d(k,m) (termed the look vector) denotes the transfer function from the target source to each of the sensor in the system, or alternatively the relative transfer functions (defined as the transfer function from any microphone to a reference microphone, see [9,10] for details).

Based on these estimated matrices, an estimate of SNR-optimal beamformers can be produced (cf. block Estimate SNR optimal beamformer in FIG. 2), one pair of—generally complex-valued—beamformer weights $w(k,m)=[w_l(k,m)w_r(k,m)]$ for each frequency band. For example, for the situation at hand, the SNR-optimal beamformer weights are given by $$w(k,m)=\frac{C_v^{-1}(k,m)d(k,m)}{d^H(k,m)C_v^{-1}(k,m)d(k,m)}.$$

Analogously to [1,2], these optimal beamformer weights are jittered (cf. block Compute jittered beamformer weights in FIG. 2). This may be written as $$\tilde{w}_l(k,m)=w_l(k,m)g(w(k,m)),$$

and $$\tilde{w}r(k,m)=w_l(k,m)g(w(k,m)),$$

where in [1,2], the function g(w(k,m)) introduces random and statistically independent gain errors and delay errors to the optimal beamformer weights; in [1,2] the gain errors and delay errors are Gaussian distributed on the logarithmic and linear scale, respectively, and the standard deviation of these errors is a function of the optimal beamformer weights w(k,m) themselves, hence the notation g(w(k,m)).

Then, the binaural signal ($y_l(t)$ and $y_r(t)$) is passed through the jittered beamformer $\tilde{w}(k,m)=[\tilde{w}_l(k,m)\tilde{w}_r(k,m)]$ (cf. block Apply jittered beamformer in FIG. 2), and using the estimated inter-aural target and noise covariance matrices, an apparent signal-to-noise ratio is computed as a function of time and frequency. Finally, these SNR values are used in a standard monaural SI prediction, e.g. the Extended Speech Intelligibility Index (ESII) [7,8] or the Short-term Objective Intelligibility (STOI) measure [11] to produce a final estimate of the intelligibility experienced by the hearing aid user (cf. block Evaluate monaural SI predictor and signal SI estimate in FIG. 2). In practice, the absolute SI (i.e., the percentage of words understood) is difficult to estimate, since it is dependent on e.g., the speaking rate, the speech signal redundancy, etc.,—quantities which are hardly available in practice (and difficult to estimate in a hearing aid system). However, the relative SI, i.e., whether the SI is improved or degraded can be estimated without detailed knowledge of the target speech signal.

Figure 4:
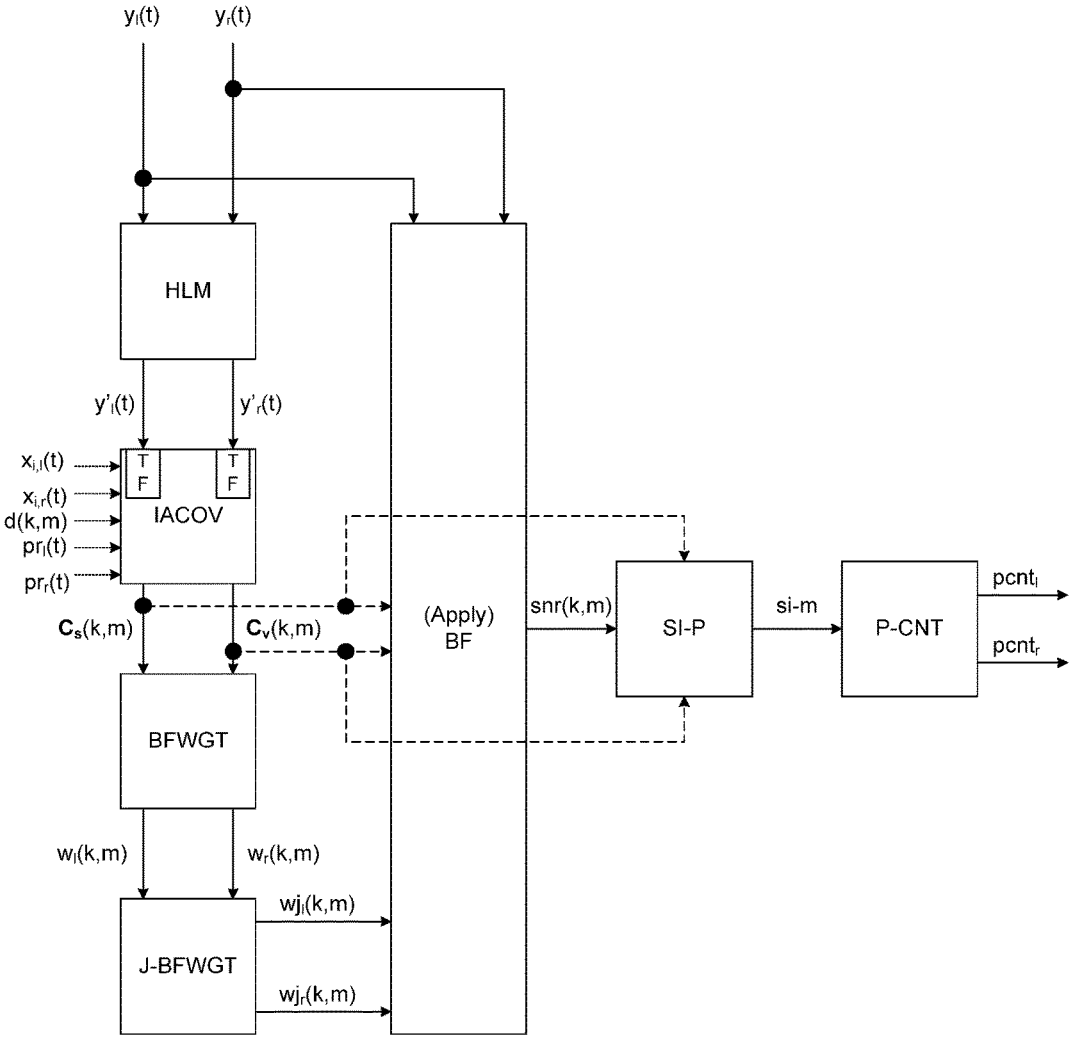
FIG. 4 shows an embodiment of a binaural speech intelligibility prediction unit according to the present disclosure.

FIG. 4 shows an embodiment of a binaural speech intelligibility prediction unit according to the present disclosure. The embodiment of FIG. 4 basically illustrates the flow diagram of FIG. 2 as functional blocks with a few additional features described in the following. The hearing loss model unit (HLM) corresponds to the step of applying a model of a user's hearing loss to the output signals $y_l$, $y_r$ of the left and right hearing devices $HD_l$, $HD_r$ (Model hearing loss in FIG. 2). The hearing loss model unit (HLM) provides resulting modified output signals $y'_l$, $y'_r$ e.g. by adding (to the original output signals $y_l$, $y_r$) uncorrelated noise, spectrally shaped according to an audiogram of the respective ears of the user. The interaural covariance estimation unit (IACOV) corresponds to the step of estimating the inter-aural target signal covariance matrix $C_s(k,m)$ and the undesired signal covariance matrix $C_v(k,m)$. (cf. Estimate inter-aural covariance matrices in FIG. 2). The interaural covariance estimation unit (IACOV) comprises respective analysis filter banks (units TF in FIG. 4) to provide the time domain signals $y'_l$, $y'_r$ in a time frequency domain representation in a number of frequency bands (k) and at a number of time instances (m), e.g. of the order of a time-frame. The interaural covariance estimation unit (IACOV) may e.g. comprise a maximum likelihood estimation unit of the target and noise covariance matrices as illustrated in FIG. 3. The input look vector d(k,m) in FIG. 3 is shown as an input d(k,m) to the IACOV unit of FIG. 4 (dashed arrow). The beamformer weight estimation unit (BFWGT) corresponds to the step of estimating SNR-optimal beamformers in the form beamformer weights $w(k,m)=[w_l(k,m)w_r(k,m)]$ for each frequency band. (cf. block Estimate SNR optimal beamformer in FIG. 2). The jittered beamformer weight estimation unit (J-BFWGT) corresponds to the step of applying jitter to the SNR optimal beamformer weights $w(k,m)=[w_l(k,m)w_r(k,m)]$ (cf. block Compute jittered beamformer weights in FIG. 2) providing jittered beamformer weights $\tilde{w}(k,m)=[\tilde{w}_l(k,m)\tilde{w}_r(k,m)]$ (denoted $wj_l(k,m)$ and $wj_r(k,m)$, respectively, in FIG. 4). The beamformer filter ((Apply) BF) corresponds to the step of applying jittered beamformer weights $\tilde{w}(k,m)=[\tilde{w}_l(k,m)\tilde{w}_r(k,m)]$ to the output signals $y_l$, $y_r$ of the left and right hearing devices $HD_l$, $HD_r$ (cf. block Apply jittered beamformer in FIG. 2). In the embodiment of FIG. 4, it is assumed that a time to time-frequency transformation of the output signals $y_l$, $y_r$ is performed in the beamformer filter ((Apply) BF), to provide the output signals $y_l$, $y_r$ in a time frequency domain representation (k,m). Alternatively, the output signals $y_l$, $y_r$ might be provided to the HLM and (Apply) BF units in a time frequency domain representation (k,m). In that case separate conversions in the IACOV and (Apply) BF units can be dispensed with. The beamformer filter ((Apply) BF) provide as an output an apparent signal-to-noise ratio snr(k, m) as a function of time and frequency. The speech intelligibility estimation unit (SI-P) for producing a final estimate of the intelligibility si-m experienced by the hearing aid user corresponds to block Evaluate monaural SI predictor and signal SI estimate in FIG. 2. The speech intelligibility estimation unit (SI-P) may further benefit from other inputs, e.g. as shown by dashed line arrows target and noise interaural covariance matrices $C_s$, $C_v$. In the block diagram of FIG. 4 a further processing control unit (P-CNT) is shown to provide separates control signals $pcnt_l$ and $pcnt_r$ for controlling or influencing the processing of the electric input signals $x_{1,l} \ldots, x_{M,l}$ and $x_{1,r}, \ldots, x_{M,r}$, respectively, to the signal processing units (SPU) of the left and right hearing devices $HD_l$, $HD_r$ (as also illustrated in FIGS. 1, 5 and 6).

Figure 5:
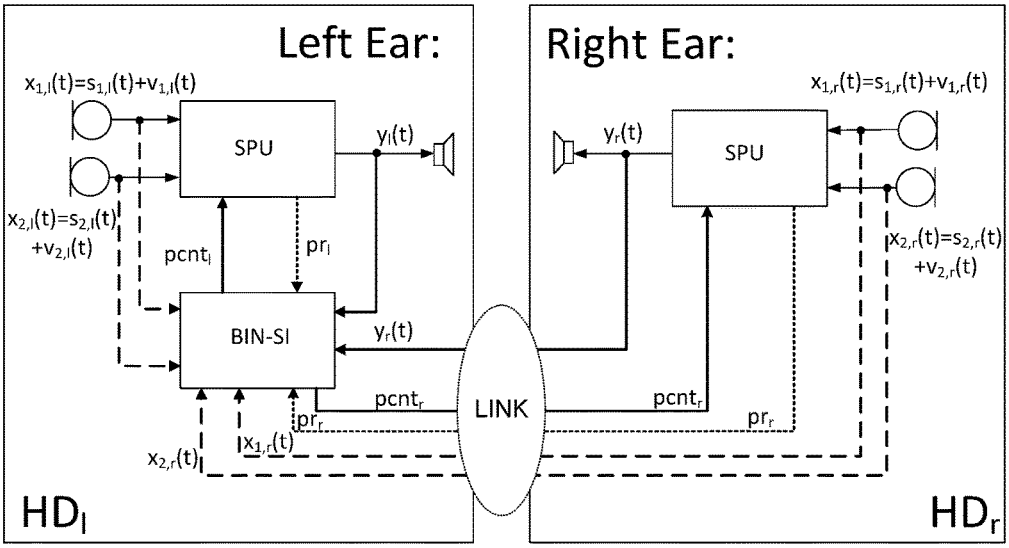
FIG. 5 shows a second embodiment of a binaural hearing system according to the present disclosure.

FIG. 5 shows a second embodiment of a binaural hearing system according to the present disclosure. The embodiment of FIG. 5 is similar to the embodiment of FIG. 1 apart from extra input signals (shown in dashed or dotted line in FIG. 5) provided to the binaural speech intelligibility prediction unit (BIN-SI) as described in the following. The signal processing of each of the left and right hearing devices is guided by an estimate of the binaural speech intelligibility experienced by the hearing aid user. To help estimate interaural covariance matrices, the binaural speech intelligibility prediction block (BIN-SI, running in the left-ear hearing device $HD_l$) uses microphone signals $x_{1,l}$, $s_{2,l}$ from the left hearing device $HD_l$, and microphone signals $x_{1,r}$, $x_{2,r}$, from the right hearing device $HD_r$ (wirelessly transmitted from left to right), all four signals shown in dashed line in FIG. 5. Furthermore, it uses knowledge of the signal processing applied to the microphone signals for the left (dotted arrow denoted $pr_l$ from the signal processing unit (SPU) of the left hearing device $HD_l$ to binaural speech intelligibility prediction unit BIN-SI) as well as wirelessly transmitted knowledge of the signal processing applied to the microphone signals in the right hearing device $HD_r$ (dotted arrow from the Signal Processing unit (SPU) of the right hearing device $HD_r$ to binaural speech intelligibility prediction block (BIN-SI).

An important step in the proposed scheme for providing a binaural speech intelligibility predictor is the estimation of the inter-aural target and noise covariance matrices $C_s$, $C_v$ of the hearing aid output signals $y_l$, $y_r$. This estimation may be difficult to perform reliably based only on the output signals ($y_l(t)$ and $y_r(t)$) of the hearing devices (as shown in in FIG. 1). Instead or additionally, these covariance matrices may be estimated using a) the noisy microphone signals $x_{1,l}$, $X_{2,l}$ and $x_{1,r}$, $x_{2,r}$ and b) the signal processing $pr_l$, $pr_r$ applied to them to arrive at y,l(t) and y,r(t) (these optional extra inputs. are also shown in FIG. 4 as inputs to the IACOV-unit (dotted arrows). Therefore, in extended versions of the idea, the binaural intelligibility prediction block uses as inputs some or all of the noisy microphone signals along with information about the signal processing applied to these signals in each HA. The information (represented by signals $pr_l$, $pr_r$) may for example be the filter weights of a beamformer (as a function of frequency), the gain/suppression applied by a single-channel noise reduction filter (as a function of frequency), the gain applied by an amplification/dynamic range compression system (as a function of frequency), etc., as illustrated in FIG. 5. Compared to the basic system in FIG. 1, more signals need to be communicated wirelessly (additional dashed lines in FIG. 5). Obviously, systems "between" the relatively simple system in FIG. 1 and the more complex system in FIG. 5 are possible.

Figure 6:
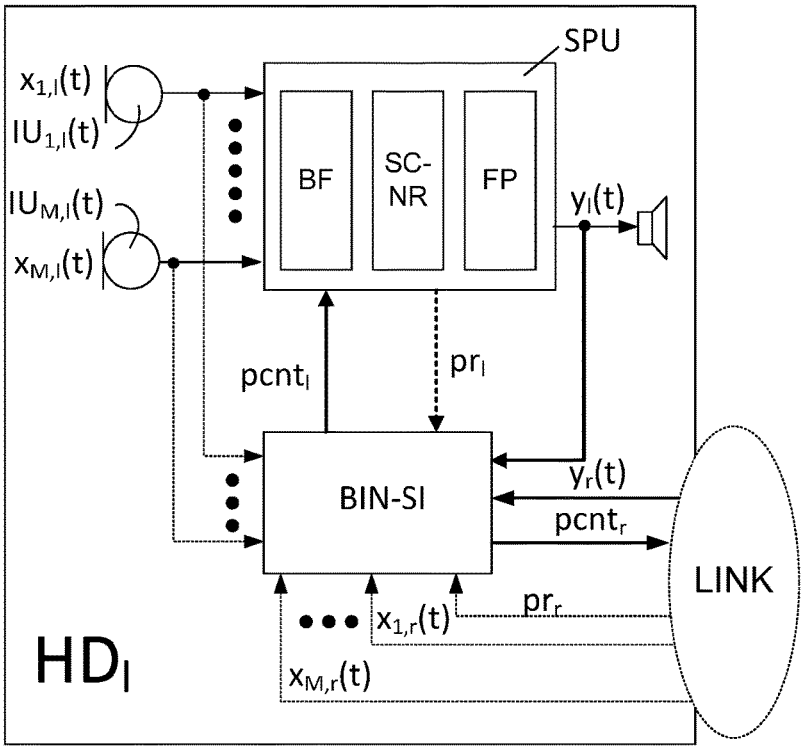
FIG. 6 shows an embodiment of a left hearing device of a binaural hearing system according to the present disclosure.

FIG. 6 shows an embodiment of a left hearing device of a binaural hearing system according to the present disclosure. The embodiment of a left hearing device ($HD_l$) of FIG. 6 is equivalent to the one shown and discussed in connection with FIG. 5. On differences is a) that instead of 2 microphones, the left hearing device ($HD_l$) of FIG. 6 comprises M input units (e.g. microphones), where $M \geq 2$, and each input unit being adapted to pick up a sound ($x_{1,l}, \ldots, x_{M,l}$) from the environment and convert it to a corresponding electric signal, which are input to the signal processing unit (SPU) as well as to the binaural speech intelligibility predictor unit (BIN-SI) together with electric input signals ($x_{1,r}, \ldots, x_{M,r}$) received via communication link (LINK) from the right hearing device ($HD_r$) of the binaural hearing system. Another difference is b) that the signal processing unit (SPU) comprises a multi input noise reduction system (comprising a beamformer filter (BF) and a single-channel noise reduction unit (SC-NR)) for providing a noise reduced estimate of the target signal, and a further processing unit (FP) for applying further processing algorithms to the noise reduced estimate of the target signal, e.g. including the application of a level and frequency dependent gain according to a user's needs, etc., to provide a resulting output signal $y_l$. The mentioned algorithms may be influenced by control signal $pcnt_l$ from the binaural speech intelligibility predictor unit (BIN-SI) to provide an optimized combined binaural speech intelligibility. Likewise, characteristics of the currently applied processing algorithms in the signal processing unit may be transferred to the binaural speech intelligibility predictor unit (BIN-SI) via signal $pr_l$, and used in the generation of processing control signal $pcnt_l$ (and $pcnt_r$).

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

[1] R. Beutelmann and T. Brand, "Prediction of speech intelligibility in spatial noise and reverberation for normal-hearing and hearing-impaired listeners," J. Acoust. Soc. Am., vol. 120, pp. 331-342, 2006.

[2] R. Beutelmann, T. Brand, and B. Kollmeier, "Revision, extension, and evaluation of a binaural speech intelligibility model," J. Acoust. Soc. Am., vol. 127, pp. 2479-2497, 2010.

[3] R. Wan, N. I. Durlach, and H. S. Colburn, "Application of an extended equalization-cancellation model to speech intelligibility with spatially distributed maskers," J. Acoust. Soc. Am., vol. 128, pp. 3678-3690, 2010

[4] S. J. van Wijngaarden and R. Drullman, "Binaural intelligibility prediction based on the speech transmission index," J. Acoust. Soc. Am., vol. 123, no. 4514-4523, 2008.

[5] M. Lavandier, S. Jelfs, J. Culling, A. J. Watkins, A. P. Raimond, and S. J. Makin, "Binaural prediction of speech intelligibility in reverberant rooms with multiple noise sources," J. Acoust. Soc. Am., vol. 131, no. 1, pp. 218-231, January 2012.

[6] J. Rennies, T. Brand, and B. Kollmeier, "Prediction of the influence of reverberation on binaural speech intelligibility in noise and in quiet," J. Acoust. Soc. Am., vol. 130, no. 5, pp. 2999-3012, November 2011.

[7] K. S. Rhebergen, "Modeling the speech intelligibility in fluctuating noise," Ph.D. dissertation, Amsterdam University, 2006.

[8] K. S. Rhebergen, N. J. Versfeld, and W. A. Dreschler, "Extended speech intelligibility index for the prediction of the speech reception threshold in fluctuating noise," J. Acoust. Soc. Am., vol. 120, pp. 3988-3997, December 2006.

[9] U. Kjems, and J. Jensen, "Maximum Likelihood Based Noise Covariance Matrix Estimation for Multi-Microphone Speech Enhancement," Proc. European Signal Processing Conference (Eusipco), pp. 295-299, 2012.

[10] J. Jensen and M. S. Pedersen, "Analysis of Beamformer Directed Single-Channel Noise Reduction System for Hearing Aid Applications," Proc. International Conference on Audio, Speech, and Signal Processing (ICASSP), 2015, Accepted.

[11] C. H. Taal, R. C. Hendriks, R. Heusdens, and J. Jensen, "An Algorithm for Intelligibility Prediction of Time-Frequency Weighted Noisy Speech," IEEE Trans. Audio., Speech, Language Processing, vol. 19, no. 7, pp. 2125-2136, September 2011.

[12] A. Kuklasinski, S. Doclo, S. H. Jensen, and J. Jensen, "Maximum Likelihood Based Multi-Channel Isotropic Reverberation Reduction for Hearing Aids," Proc. European Signal Processing Conference (Eusipco), September 2014.

[13] H. Dillon, "Hearing Aids," Boomerang Press—Thieme, 2001.

The invention claimed is:

1. A binaural hearing system comprising left and right hearing devices adapted for being located at or in left and right ears of a user, or adapted for being fully or partially implanted in the head of the user, each of the left and right hearing devices comprising a) A multitude of input units $IU_i$, i=1, M, M being larger than or equal to two, each being configured to provide a time-variant electric input signal $x_i(t)$ representing sound received at an $i^{th}$ input unit, t representing time, the electric input signal $x_i(t)$ comprising a target signal component $s_i(t)$ and a noise signal component $v_i(t)$, the target signal component originating from a target signal source;

b) A configurable signal processing unit for processing the electric input signals and providing a processed signal y(t);

c) An output unit for creating output stimuli configured to be perceivable by the user as sound based on the processed signal from the signal processing unit, d) Transceiver circuitry for allowing a communication link to be established and information to be exchanged between said left and right hearing devices, wherein the binaural hearing system further comprises e) A binaural speech intelligibility prediction unit for providing a binaural SI-measure of the predicted speech intelligibility of the user when exposed to said output stimuli, based on the processed signals $y_l(t)$, $y_r(t)$ from the signal processing units of the respective left and right hearing devices, wherein the configurable signal processing units of the left and right hearing devices are adapted to control the processing of the respective electric input signals based on said binaural SI-measure.

2. A binaural hearing system according to claim 1 configured to provide the processed signals $y_l(t)$, $y_r(t)$ and/or one or more of the electric input signals $x_{i,l}(t)$, $x_{i,r}(t)$, i=1, 2, . . . , M, of the left and right hearing devices, respectively, in a time-frequency representation, $Y_l(k,m)$, $Y_r(k,m)$, $X_{i,l}(k,m)$, $X_{i,r}(k,m)$, respectively, in a number of frequency bands and a number of time instances, k being a frequency band index, m being a time index.

3. A binaural hearing system according to claim 1 wherein said binaural speech intelligibility prediction unit is located in a first one of the left and right hearing devices.

4. A binaural hearing system according to claim 1 comprising an auxiliary device wherein said binaural speech intelligibility prediction unit is located, said left and right hearing devices and said auxiliary device each comprising respective antenna and transceiver circuitry for allowing a communication link to be established and information to be exchanged between said auxiliary device and said left and right hearing devices.

5. A binaural hearing system according to claim 1 wherein said binaural speech intelligibility prediction unit comprises a hearing loss model unit for modelling a hearing loss of the user to provide HL-modified signals $y'_l(t)$ and $y'_r(t)$, based on the processed signals $y_l(t)$ and $y_r(t)$, respectively.

6. A binaural hearing system according to claim 5, wherein said hearing loss model unit is configured to add uncorrelated noise, which is spectrally shaped according to the user's frequency dependent hearing loss, to the the processed signals $y_l(t)$, $y_r(t)$ of the respective left and right hearing devices to provide HL-modified signals $y'_l(t)$ and $y'_r(t)$.

7. A binaural hearing system according to claim 2 wherein said binaural speech intelligibility prediction unit comprises a covariance estimation unit configured to provide an estimate of the inter-aural target and noise covariance matrices $C_s(k,m)$ and $C_v(k,m)$, respectively, for each frequency band of the signals involved.

8. A binaural hearing system comprising according to claim 1 wherein said binaural speech intelligibility prediction unit comprises a beamformer unit for providing respective estimates of SNR-optimal beamformers comprising—generally complex-valued—beamformer weights $w_l(k,m)$ and $w_r(k,m)$, respectively, for each frequency band and time instant.

9. A binaural hearing system according to claim 8 wherein said binaural speech intelligibility prediction unit comprises a perturbation unit for applying jitter to said SNR-optimal beamformer weights $w_l(k,m)$ and $w_r(k,m)$, to provide respective jittered beamformer weights $\tilde{w}_l(k,m)$ and $\tilde{w}_r(k,m)$.

10. A binaural hearing system according to claim 1 wherein said binaural speech intelligibility prediction unit comprises a beamformer filter wherein the processed signals $y_l(t)$ and $y_r(t)$ of the left and right hearing devices, respectively, are filtered using the respective SNR-optimal beamformer weights $w_l(k,m)$ and $w_r(k,m)$ or the respective jittered beamformer weights $\tilde{w}_l(k,m)$ and $\tilde{w}_r(k,m)$ to provide, an estimated signal-to-noise ratio snr(k,m) computed as a function of time and frequency.

11. A binaural hearing system according to claim 10 wherein said binaural speech intelligibility prediction unit comprises a speech intelligibility prediction unit for providing a resulting SI-measure based on the estimated time-frequency dependent signal-to-noise ratio snr(k,m).

12. A binaural hearing system according to claim 11 wherein the resulting SI-measure is further based on said estimates of the inter-aural target and noise covariance matrices $C_s(k,m)$ and $C_v(k,m)$, respectively.

13. A binaural hearing system according to claim 1 wherein said binaural speech intelligibility prediction unit comprises a processing control unit for providing respective processing control signals to control the processing of the respective electric input signals in the configurable signal processing units of the left and right hearing devices, respectively, based on said binaural or said resulting SI-measure.

14. A binaural hearing system according to claim 1 wherein said binaural speech intelligibility prediction unit is configured to provide said binaural or said resulting SI-measure based on said processed signals $y_l(t)$ and $y_r(t)$ of the left and right hearing devices, respectively, and one or more of the electric input signals $x_{i,l}(t)$, $x_{i,r}(t)$, i=1, 2, . . . , M, of the left and right hearing devices, respectively and/or on information regarding the processing currently applied to the electric input signals of the signal processing units of the left and right hearing devices, respectively.

15. A binaural hearing system according to claim 14 wherein said information regarding the processing currently applied to the electric input signals of the signal processing units of the left and right hearing devices, respectively, comprises one or more of information regarding a) filter weights of a beamformer as a function of frequency, b) gain/suppression applied by a single-channel noise reduction filter as a function of frequency, c) gain applied by an amplification/dynamic range compression system as a function of frequency.

16. A binaural hearing system according to claim 1 wherein said left and right hearing devices comprises a hearing aid, a headset, an earphone, an ear protection device or a combination thereof.

17. A method of providing a binaural speech intelligibility predictor in a binaural hearing system comprising left and right hearing devices adapted for being located at or in left and right ears of a user, or adapted for being fully or partially implanted in the head of the user, the method comprising modelling a potential hearing loss by adding uncorrelated noise, spectrally shaped according to the haring loss of the user;

estimating the inter-aural target and noise covariance matrices for each frequency sub-band of the output signals of the left and right hearing devices;

estimating SNR-optimal beamformers in the form of, generally complex-valued, beamformer weights for each frequency band for the left and right hearing devices, respectively;

generating jittered beamformer weights by applying jitter to the beamformer weights for each frequency band for the left and right hearing devices, respectively;

applying jittered beamformer weights to the output signals of the left and right hearing devices thereby providing an apparent signal-to-noise ratio as a function of time and frequency;

producing a final estimate of the speech intelligibility experienced by the user.

18. A data processing system comprising a processor and program code means for causing the processor to perform the steps of the method according to claim 17.

* * * * *